US008713923B2

(12) United States Patent
Morita et al.

(10) Patent No.: US 8,713,923 B2
(45) Date of Patent: May 6, 2014

(54) EXHAUST SYSTEM FOR MOTORCYCLE

(75) Inventors: Kenji Morita, Saitama (JP); Yuichi Tanaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 966 days.

(21) Appl. No.: 12/056,065

(22) Filed: Mar. 26, 2008

(65) Prior Publication Data

US 2008/0236152 A1 Oct. 2, 2008

(30) Foreign Application Priority Data

Mar. 30, 2007 (JP) ..... 2007-095483

(51) Int. Cl.
*F02B 27/02* (2006.01)
*F01N 7/10* (2006.01)
*F01N 7/00* (2006.01)

(52) U.S. Cl.
USPC ..... 60/313; 60/323; 60/324

(58) Field of Classification Search
USPC ..... 60/276, 312, 313, 323, 324; 180/219, 180/309; 181/227, 255
See application file for complete search history.

(56) References Cited

U.S. PATENT DOCUMENTS

| | | | | |
|---|---|---|---|---|
| 4,553,388 | A * | 11/1985 | Okubo et al. | 60/276 |
| 5,653,303 | A * | 8/1997 | Kawamoto | 180/219 |
| 6,761,239 | B2 * | 7/2004 | Kawamoto | 180/219 |
| 7,350,351 | B2 * | 4/2008 | Ueshima et al. | 60/299 |
| 7,818,964 | B2 * | 10/2010 | Muramatsu et al. | 60/324 |
| 2006/0053780 | A1 * | 3/2006 | Kikuchi et al. | 60/299 |
| 2007/0107419 | A1 * | 5/2007 | Taniguchi et al. | 60/299 |

FOREIGN PATENT DOCUMENTS

| | | | |
|---|---|---|---|
| DE | 196 35 007 | A1 | 3/1997 |
| EP | 1 749 987 | A2 | 2/2007 |
| JP | 58-224812 | A | 12/1983 |
| JP | 7-46725 | A | 10/1995 |
| JP | 3727641 | B2 | 10/2005 |

* cited by examiner

*Primary Examiner* — Thomas Denion
*Assistant Examiner* — Diem Tran
(74) *Attorney, Agent, or Firm* — Birch, Stewart, Kolasch & Birch, LLP

(57) ABSTRACT

An exhaust system for a motorcycle includes a plurality of exhaust pipes connected respectively to exhaust ports of cylinders of a multi-cylinder engine; a manifold portion connected to the exhaust pipes; and a muffler connected to a downstream side of the manifold portion, the manifold portion being disposed below the engine, wherein the manifold portion is disposed sideways of an oil pan disposed below the engine so as to overlap the oil pan when seen in a side view of the motorcycle, and the exhaust pipes are connected to the manifold portion from a front side of the motorcycle.

14 Claims, 6 Drawing Sheets

EXHAUST SYSTEM FOR MOTORCYCLE

CROSS-REFERENCE TO RELATED APPLICATIONS

This nonprovisional application claims priority under 35 U.S.C. §119(a) on Patent Application No. 2007-095483, filed in Japan on Mar. 30, 2007, the entirety of which is incorporated herein by reference.

BACKGROUND OF THE INVENTION

1. Field of the Invention

The present invention relates to an exhaust system for a motorcycle, and particularly, to an advantageous layout structure of an exhaust pipe manifold portion in a multi-cylinder engine.

2. Background of the Invention

It is well known to gather exhaust pipes of a multi-cylinder engine to a manifold portion forming an expansion chamber and allow exhaust gas to expand therein, thereby reducing an exhaust noise. Japanese Patent No. 3727641 discloses a structure, wherein the manifold portion is disposed below the engine. JP 07-046725Y discloses a structure, wherein the manifold portion is disposed between a rear portion of the engine and a rear wheel and below a rear swing arm. It has also been proposed to dispose a catalyst within the manifold portion to purify exhaust gas.

The manifold portion is relatively large in capacity. Therefore, if it is disposed below the engine, it becomes difficult to ensure a sufficient lowest road clearance. On the other hand, the manifold portion is heavy. Therefore, if it is disposed behind the engine, it becomes difficult to effect the mass concentration. The mass concentration is also strongly demanded together with lowering the center of gravity. The demand for mass concentration is also a basic and one of the most important demands in a body design of a motorcycle. The demand for lowering the center of gravity is also a basic and one of the most important, keen demands.

For attaining the mass concentration and the lowering of the center of gravity, it is preferable to dispose the manifold portion below the engine. To ensure a sufficient minimum road clearance, it is preferable to dispose the manifold portion behind the engine. These methods, however, are difficult to both ensure a sufficient minimum road clearance and attain the mass concentration and the lowering of the center of gravity to a satisfactory extent.

SUMMARY OF THE INVENTION

Accordingly, it is a primary object of the present invention to provide a layout of the manifold portion capable of meeting both such demands that conflict with each other.

To achieve the above-mentioned object, according to a first aspect of the present invention, there is provided an exhaust system for a motorcycle having a plurality of exhaust pipes connected respectively to exhaust ports of cylinders of a multi-cylinder engine, a manifold potion with the plurality of exhaust pipes connected thereto, and a muffler connected to a downstream side of the manifold portion, the manifold portion being disposed below the engine. The manifold portion is disposed sideways of an oil pan disposed below the engine so as to overlap the oil pan when seen in side view, and the exhaust pipes are connected to the manifold portion from a front side of the motorcycle.

Furthermore, according to a second aspect of the present invention, the oil pan is provided at a part of its bottom with a downwardly expanded portion and the manifold portion is disposed sideways of and in parallel with the expanded portion.

Furthermore, according to a third aspect of the present invention, a suction port of a strainer for sucking oil is disposed within the expanded portion.

Furthermore, according to a fourth aspect of the present invention, the multi-cylinder engine is a longitudinal V engine, the exhaust port of a front cylinder is connected to a first exhaust pipe, and the exhaust port of a rear cylinder is connected to a second exhaust pipe, the first exhaust pipe extending in front of the engine and being connected to the manifold portion from the front side, the second exhaust pipe extending from behind the engine, passing a side face of the oil pan below the engine, and extending curvedly in front of the engine and being connected to the manifold portion from the front side of the motorcycle, and the side face of the oil pan lies on a side opposite to a disposed side of the manifold portion.

Furthermore, according to a fifth aspect of the present invention, the second exhaust pipe passes the opposite side of the manifold portion with the expanded portion of the oil pan therebetween.

Furthermore, according to a sixth aspect of the present invention, a catalyst is disposed in the manifold portion.

Furthermore, according to a seventh aspect of the present invention, an $O_2$ sensor is disposed near the exhaust pipe positioned in front of the manifold portion.

According to the first aspect of the present invention, since the manifold portion is disposed below the engine and sideways in parallel with the oil pan and the exhaust pipes are connected to the manifold portion from a front side of the engine, it is possible to not only ensure a sufficient minimum road clearance but also attain the mass concentration and a lowering of the center of gravity.

Furthermore, according to the second aspect of the present invention, since oil can be stored in the expanded portion of the oil pan, it is possible to ensure a sufficient amount of oil in the expanded portion and permit the other portion to be relatively thin without projecting downward too much. Consequently, it is possible to ensure a sufficient oil storage capacity of the oil pan. In addition, by making the other portion thin and disposing the manifold portion thereunder, it becomes easier to ensure a sufficient minimum road clearance.

Furthermore, according to the third aspect of the present invention, since the strainer suction port is disposed within the expanded portion to suck oil, even in the case of an oil pan which is thin as a whole, it is possible to effect the suction of oil efficiently. Besides, since oil is stored at a certain depth within the expanded portion which is relatively narrow, it is possible to ensure an appropriate amount of oil and hence prevent the occurrence of oil shortage in the event of tilting of the vehicle body.

Furthermore, according to the fourth aspect of the present invention, the manifold portion is disposed on one of both side faces of the oil pan, the second exhaust pipe is disposed on the other side, and the front curved portions of the first and second exhaust pipes are disposed in front of the manifold portion. By thus disposing the first and second exhaust pipes and the manifold portion all together around the oil pan it is possible to secure a minimum road clearance and attain the lowering of the center of gravity and the mass concentration simultaneously.

Furthermore, according to the fifth aspect of the present invention, the manifold portion and the second exhaust pipe, as heating sources, are disposed with the expanded portion of the oil pan therebetween. Since the space under the oil pan which is thin is thus utilized, it is possible to secure a minimum road clearance and attain the lowering of the center of gravity and the mass concentration. Particularly, the manifold portion and the second exhaust pipe can be disposed in proximity to the center of the vehicle body, which is advantageous to the mass concentration.

Furthermore, according to the sixth aspect of the present invention, since a catalyst is disposed in the manifold portion, it becomes easier to dispose the catalyst and the lowering of the center of gravity and the mass concentration become more remarkable by an amount corresponding to the weight increase of the catalyst. Moreover, since the catalyst is disposed near the exhaust ports of the engine, exhaust gas of a relatively high temperature comes into contact with the catalyst, so that activation in an early stage of the catalyst becomes possible and hence the purification of the exhaust gas is promoted. Besides, since the catalyst is surrounded with a rigid wall of the manifold portion and is guarded by the exhaust pipes and the oil pan, the protection against disturbance is strengthened.

Furthermore, according to the seventh aspect of the present invention, since an $O_2$ sensor is disposed near the exhaust pipe positioned in font of the manifold portion, the $O_2$ sensor can be surrounded by the exhaust pipe and the manifold portion. Therefore, the protection against disturbance is ensured.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE ILLUSTRATED EMBODIMENTS

Figure 1:
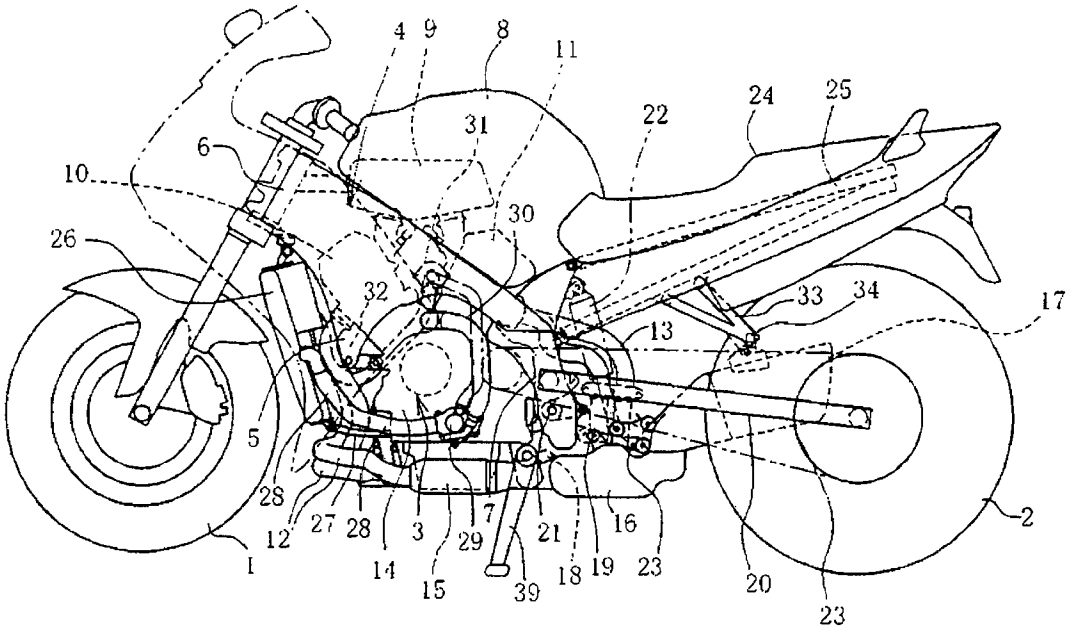
FIG. 1 is a side view of a motorcycle according to an embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

An embodiment of the present invention will now be described with reference to the drawings. FIG. 1 is a side view of a motorcycle according to the embodiment of the present invention. In the motorcycle, a water-cooled four-cylinder V engine 3 is disposed between a front wheel 1 and a rear wheel 2, and is supported by a body frame 4.

A hanger 5 is provided in an intermediate portion of the body frame 4, and a front portion of the engine 3 is supported thereby. A head pipe 6 is mounted in a front end portion of the body frame 4, while a pivot plate 7 is supported by a rear portion of the body frame.

A fuel tank 8 is supported on the intermediate portion of the body frame 4, and an intake box 9 is accommodated inside a front portion of the fuel tank 8.

The intake box 9 sucks air from the front side and feeds the sucked air into the front cylinders 10 and rear cylinders 11 which are all positioned below the intake box 9. The intake box 9 is disposed above a valley portion between the front cylinders 10 and the rear cylinders 11.

Front exhaust pipes 12 extend forward from the front cylinders 10, while rear exhaust pipes 13 extend backward from the rear cylinders 11.

The front exhaust pipes 12 extend downward along a front face of a crankcase 14 of the engine 3, and are connected through a manifold pipe to a catalyst chamber 15 from the front side. The catalyst chamber 15 is positioned below the crankcase 14. The rear exhaust pipes 13 are also connected from the front side to the catalyst chamber 15 through another manifold pipe as will be described later.

The catalyst chamber 15 is connected to an exhaust chamber 16. The exhaust chamber 16 is an expansion chamber disposed behind the catalyst chamber. The exhaust chamber 16 is disposed within a space formed between a lower portion of the crankcase 14 and the rear wheel 2, and is connected to a muffler 17. The muffler 17 extends rightwards of the vehicle body with respect to the rear wheel 2. The exhaust chamber 16 is secured to a lower end of the pivot plate 7 at two front and rear mounting portions 18, 19.

The muffler 17 is disposed while crossing a rear swing arm 20 in a side view. A front end portion of the rear swing arm 20 is secured to a lower portion of the muffler 17 vertically swingably through a pivot shaft 21, and is suspended by a rear cushion 22 disposed between the rear swing arm 20 and an upper end of the pivot plate 7.

A suspension link 23 is disposed between the lower end of the pivot plate 7 and an intermediate part of the mounting portion 18. The exhaust chamber 16 is disposed below the suspension link 23 so as to sidestep away from the suspension link, and a front end portion of the muffler 17 is substantially level with the suspension link 23 which is a little higher than the exhaust chamber 16.

The rear wheel 2 is a shaft drive type and is driven by the engine 3. A seat 24 is supported on the seat rails 25 at a position above the rear swing arm 20 and behind the fuel tank 8. Each of the seat rails 25 is secured at a front end thereof to the pivot plate 7.

A radiator 26 is disposed in front of the front cylinders 10 and behind the front wheel 1, and an upper portion thereof is secured in a suspended state to the front portion of the body frame 4 in the vicinity of the head pipe 6. The radiator 26 is supported in a forwardly inclined attitude such that the upper portion thereof tilts forward. A gap is formed between the front cylinders 10 and the crankcase 14, and the front exhaust pipes 12 are passed vertically into the gap.

A lower end of the radiator 26 is secured to the crankcase 14 by a stay 27. The stay 27 extends forward from a front lower portion of the crankcase. A water supply hose 28 extends backward from a side tank of the radiator 26, and is connected to a water tank 29 disposed sideways of the crankcase 14.

Water is supplied from the water pump 29 through a joint hose 30 to a water jacket water-supply portion formed in the valley between the front cylinders 10 and the rear cylinders 11, and then is supplied therefrom to the water jackets of the front and rear cylinders 10, 11. Hot water resulting from cooling the cylinders while circulating through the water jackets to effect heat exchange is fed to a return hose 32 through a thermostat 31. The thermostat 31 is positioned above the water supply portion in the valley between the front and rear cylinders 10, 11.

The return hose 32 once descends to a side face of the crankcase 14, then extends forward, and is connected to the side tank of the radiator 26 to return the hot water to the radiator 26.

Figure 2:
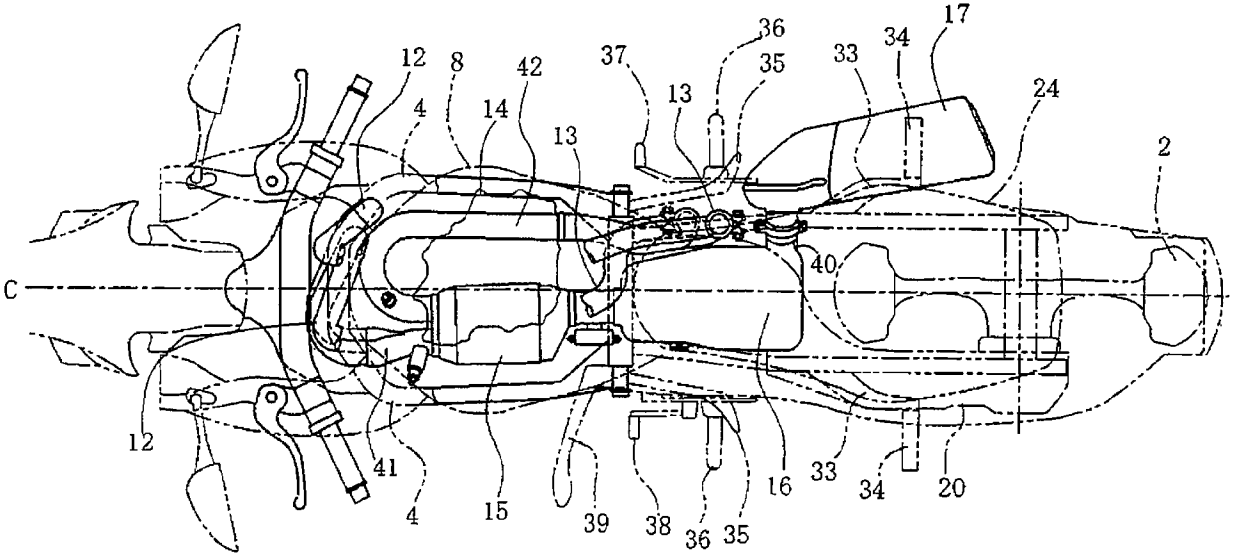
FIG. 2 is a plan view mainly showing an exhaust system according to an embodiment of the present invention.

FIG. 2 is a plan view mainly showing the exhaust system of the illustrated embodiment. The catalyst chamber 15 is disposed so as to be offset to the left side with respect to a vehicle body center C, while the exhaust chamber 16 is positioned approximately on the vehicle body center C. A horizontal outlet pipe 40 which projects outwards to the right side is provided in a right-hand rear end part of the exhaust chamber 16, and is connected to a left side face of the front end portion of the muffler 17.

The muffler 17 is disposed in the longitudinal direction and extends sideways on the right-hand side of the rear wheel 2 while tilting so that its rear side expands outwards to the right-hand side of the vehicle body.

The front exhaust pipes 12 are provided in a total of two pipes for the right and left cylinders respectively. The front exhaust pipes 12 descend toward the right-hand side of the vehicle body. Their lower portions are bent and cross the vehicle body from the right- to the left-hand side and then are gathered to a front manifold pipe 41 on the left-hand side of the vehicle body and are connected to the catalyst chamber 15. The rear exhaust pipes 13 are also provided in a total of two pipes for the right and left cylinders respectively, but are gathered at a lower position to a rear manifold pipe 42 into a single pipe. The rear manifold pipe 42 passes the right side below the crankcase 14 so as not to interfere with the crankcase. The rear manifold pipe 42 extends forward from behind, and then extends curvedly to the left-hand side of the vehicle body at a position where it becomes close to the lower portions of the front exhaust pipes 12. In addition, inside the manifold pipe 41, it is connected to the catalyst chamber 15 from the front side.

The crankcase 14 partially overlaps the catalyst chamber 15 and the rear manifold pipe 42 from above in a plan view.

Pillion step holders 33, pillion step 34 and step holder 35 are provided on the right and left of the vehicle body. The right-hand one supports the muffler 17 at a lower end portion thereof. The step holders 35 are secured to the seat rails 25. Steps 36, a brake pedal 37, a change pedal 38, and a side stand 39 are secured to a lower portion of the pivot plate 7.

Figure 3:
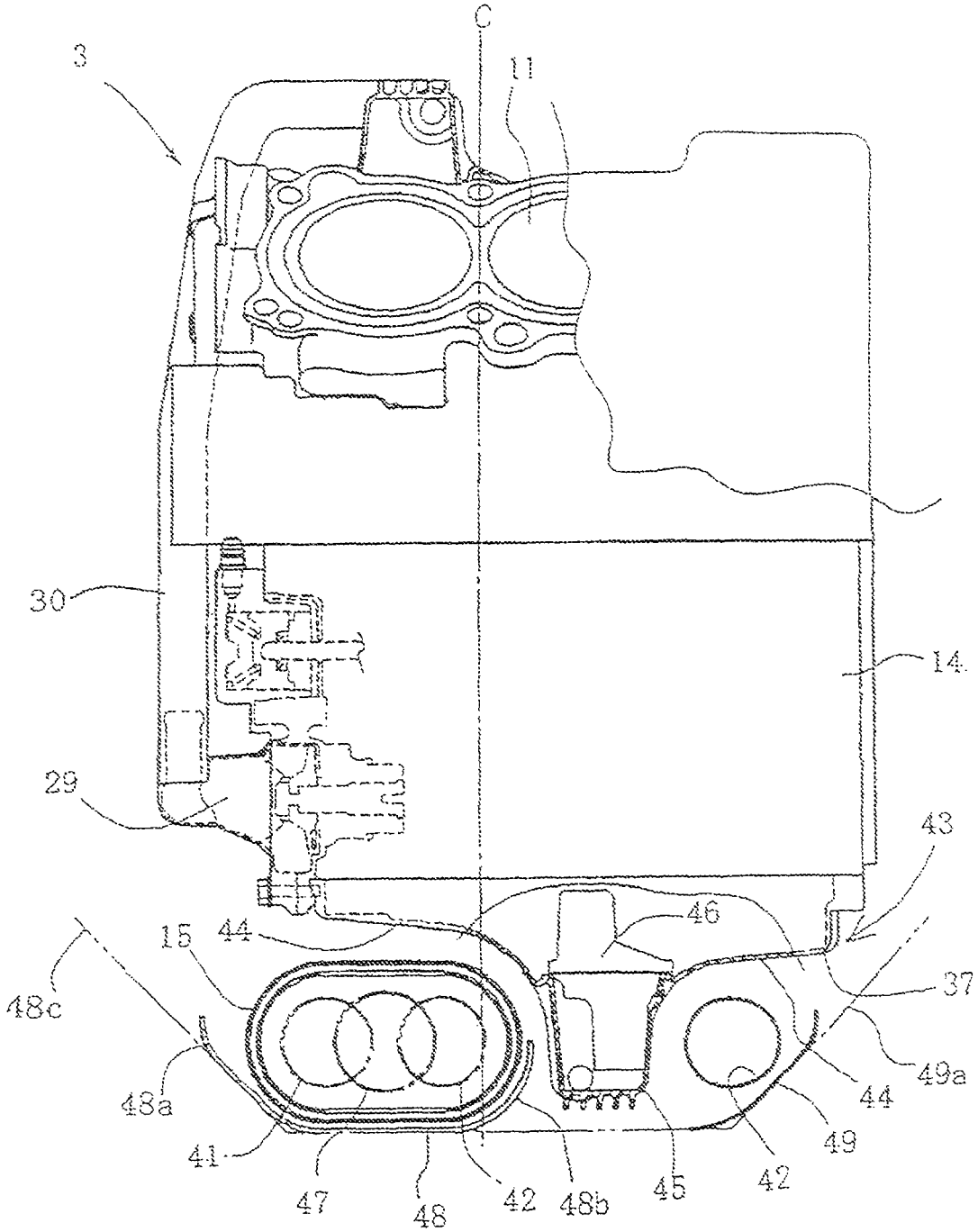
FIG. 3 is a view of an engine as seen from behind according to an embodiment of the present invention.

FIG. 3 illustrates the engine from behind. An oil pan 43 is mounted to a bottom of the crankcase 14. The oil pan 43 is curved in such a manner that a bottom 44 thereof becomes lower toward the center in the transverse direction of the vehicle body. A central portion of the bottom 44 projects downward to form a storage chamber 45. The portion of the bottom 44 other than the storage chamber 45 functions as an inlet portion for conducting oil into the storage chamber 45. It can be formed thin because it does not so much function as an oil storage portion. Therefore, the oil pan 43 is thin as a whole and is generally a T shape when seen from behind (or from the front).

The storage chamber 45 is formed as a narrow, relatively deep and longitudinally long recess (see also FIG. 5), ensuring sufficiently large spaces for the rear manifold pipe 42 and the catalyst chamber 15. An upper portion of the storage chamber 45 is contiguous to the bottom 44 which projects toward the right and the left, so that oil can be gathered efficiently into the storage chamber 45. A strainer 46 is accommodated within the oil pan 43 so that a suction port thereof is positioned near the bottom of the storage chamber 45. The strainer 46 sucks oil stored in the deep storage chamber 45 upward and the oil is fed to various portions to be lubricated such as journal portions of the cylinders by using an oil pump (not shown) disposed within the crankcase 14. By disposing the suction portion of the strainer 46 near the bottom of the narrow and relatively deep storage chamber 45, a sufficient amount of oil can be ensured around the suction port at all times and can be sucked stably even when the vehicle body tilts. At the right and left of the storage chamber 45 are disposed the rear manifold pipe 42 and the catalyst chamber 15 so as to extend in the longitudinal direction and be in proximity to the storage chamber.

The storage chamber 45 is located at a position somewhat offset to the right-hand side with respect to the vehicle body center C, forming a relatively large space under its left-hand bottom portion 44, in which the catalyst chamber 15 is disposed. The front manifold pipe 41 and the rear manifold pipe 42 are connected to a front face of the catalyst chamber 15, while one rear exhaust pipe 47 is connected to a rear face of the catalyst chamber. The catalyst chamber 15 is a relatively flat cylindrical body of an oblong section and a catalytic converter of a honeycomb structure or the like for the purification of exhaust gas is accommodated in the interior of the catalyst chamber.

Below the catalyst chamber 15 is disposed a guard plate 48. The guard plate 48 has right and left bent side portions 48*a*, 48*b* so that the bent side portions surround the catalyst chamber 15 on both the right and left sides of the same chamber. The right side portion 48*b* gets in between the catalyst chamber 15 and the storage chamber 45 in a curved shape along the catalyst chamber. The guard plate 48 is disposed inclinedly so as to extend along a left bank line 48*c*.

Also on the right-hand side of the storage chamber 45 and under the bottom 44 there is formed a space which is somewhat smaller than that formed on the left-hand side, and one rear manifold pipe 42 is passed into the space longitudinally.

A guide plate 49 is also disposed in a right-hand oblique lower position with respect to the rear manifold pipe 42. The guide plate 49 is also disposed inclinedly along a right bank line 49*a*. Each of the left bank line 48*c* and the right bank line 49*a* is a line representing a bank angle of the vehicle body.

A more detailed description will be given below for the exhaust system.

Figure 4:
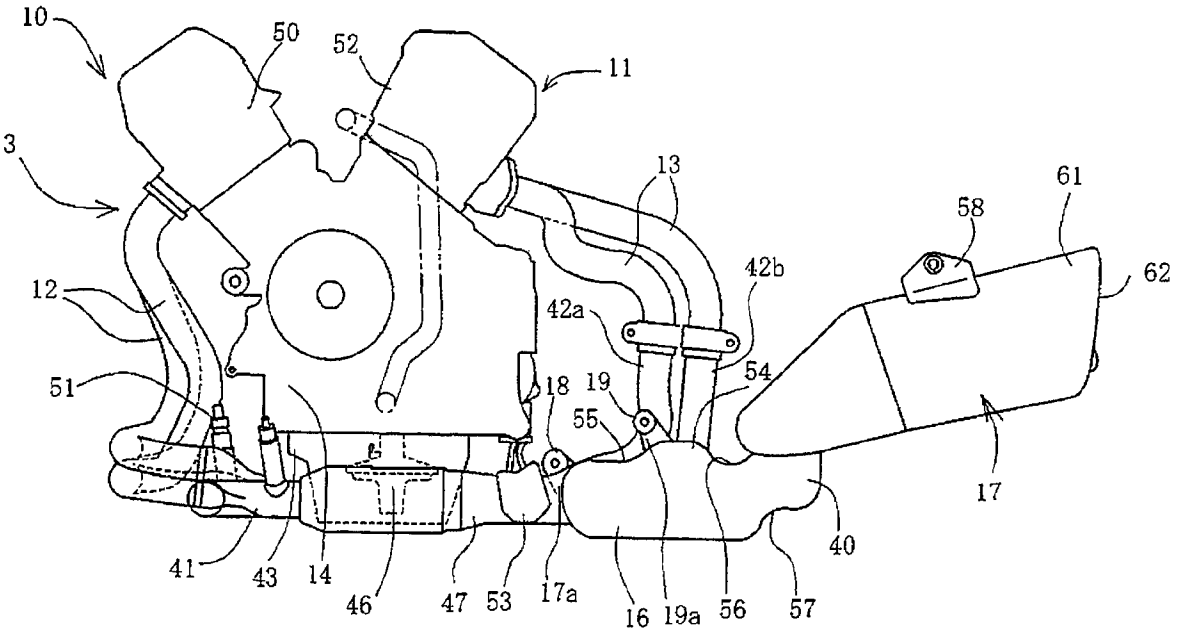
FIG. 4 is a side view of an exhaust system portion according to an embodiment of the present invention.

FIG. 4 is a side view of an exhaust system portion. Cylinder heads 50 of the front cylinders 10 are formed on the right and left. The two front exhaust pipes 12 connected to the exhaust ports of the cylinders extend downward in front of the crankcase 14, then are bent in respective lower portions, and are connected to the front manifold pipe 41 which is generally Y-shaped. A rear portion of the front manifold pipe 41 is connected as a single pipe to the catalyst chamber 15, and an $O_2$ sensor 51 is disposed in an upwardly projecting state on an upper surface of the front manifold pipe 41 at a position just before the connection with the catalyst chamber 15.

Also at a position near the connection of the rear manifold pipe 42 with the catalyst chamber 15 (the pipe 42 is not visible because of overlapping with the front manifold pipe 41 in the figure), there is disposed an $O_2$ sensor 51 in an upwardly projecting state. The $O_2$ sensor 51 measures the concentration of oxygen in exhaust gas before purification.

Cylinder heads 52 of the rear cylinders 11 are formed on the right and left. The two rear exhaust pipes 13 extend obliquely downward and backward from the exhaust ports of the cylinders, then are bent above the exhaust chamber 16 and extend substantially vertically and downwards, then are connected to branch portions 42*a* and 42*b* of the rear manifold pipe 42, which is also generally Y-shaped.

A rear exhaust pipe 47 connects a rear portion of the catalyst chamber 15 and a front portion of the exhaust chamber 16 with each other. A drive portion of an exhaust valve 53 is exposed from a side face of the rear exhaust pipe 47. The exhaust valve 53 causes a sectional area of an internal passage of the rear exhaust pipe 47 to change in accordance with traveling conditions and thereby controls displacement.

A bottom of the catalyst chamber 15 and that of the exhaust chamber 16 are substantially level with each other, lying on a horizontal line H and thus ensuring a sufficient minimum road clearance. A vertical width (thickness) of the exhaust chamber 16 is thicker than the catalyst chamber 15. However, by extending its upper surface upward, there is ensured a required vertical width. This is made possible by disposing front and rear portions of the exhaust chamber 16 within the space sandwiched in between a lower portion of the engine 3 and the rear wheel and by utilizing the space formed under the rear swing arm 20 (FIG. 1) which is positioned above.

An intermediate portion of the upper surface of the exhaust chamber 16 is formed as a raised portion 54. The recesses 55 and 56 are formed before and behind the raised portion. The recess 55 is for relief from the lower end portion of the pivot plate 7. Likewise, the recess 56 is for relief from the suspension link 23.

Stays 18*a* and 19*a* project upward from a front end portion and the raised portion 54, respectively, of the exhaust chamber 16. The mounting portions 18 and 19 are disposed at tip ends of the stays 18*a* and 19*a*, respectively, for rubber mounting to the pivot plate 7. The outlet pipe 40 extends backward from a rear end portion of the exhaust chamber 16 while being reduced in diameter. A recess 57 is formed by throttling the rear end portion of the exhaust chamber 16 which is for forming the outlet pipe 40.

The muffler 17 has a front portion 60 which is generally triangular, and a body portion 61. The front portion 60 and the body portion 61 are joined together in series by welding. The outlet pipe 40 is connected to a side face of the front portion 60 in the vicinity of an acute front end 60*a* of the front portion. An upper surface 60*b* of the front portion is a forwardly and obliquely descending tapered surface. In the portion of the outlet pipe 40, the front end 60*a* of the front portion 60 partially overlaps the rear end of the exhaust chamber 16.

The body portion 61 is a cylindrical portion having a nearly constant diameter, and a rear end thereof is closed with an oblique end cap 62 whose upper portion projects backward to a greater extent. A stay 58 is attached to the associated pillion step holder 33 (see FIG. 1).

Figure 5:
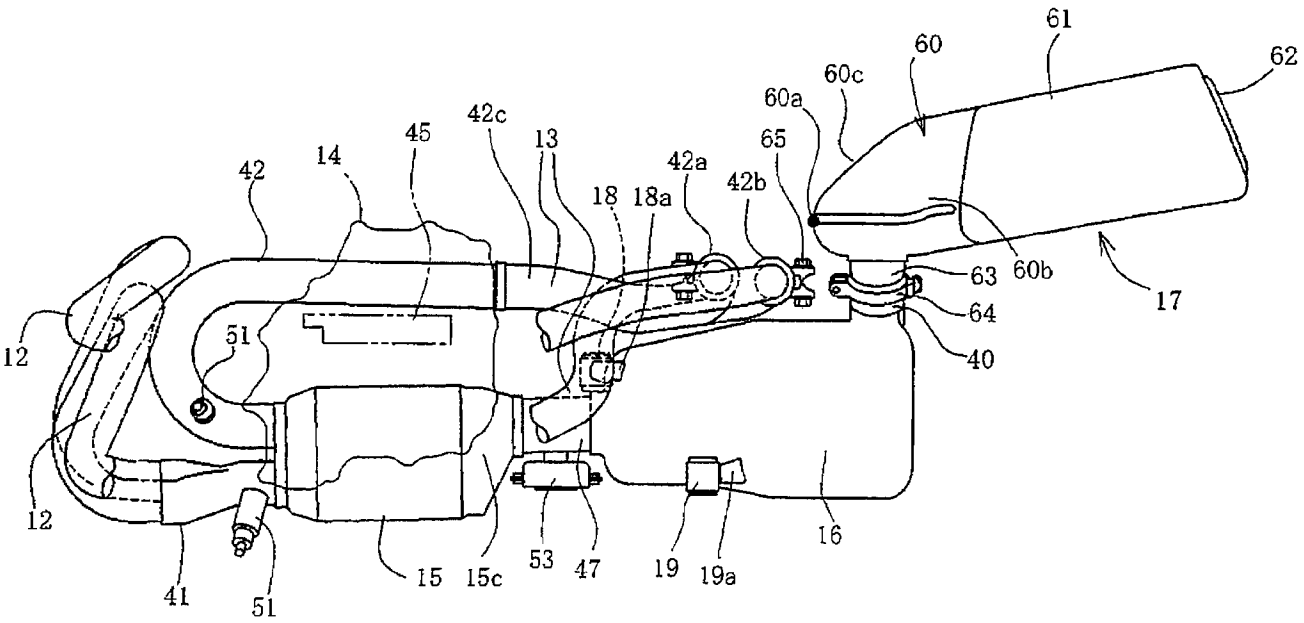
FIG. 5 is a plan view thereof according to an embodiment of the present invention.

FIG. 5 is a plan view of the exhaust system portion. In the exhaust system portion, the lower portions of the front exhaust pipes 12 bent in the vehicular transverse direction in front of the rear manifold pipe 42 overlap each other vertically. The rear exhaust pipes 13 extend backward up to near the outlet pipe 40 in a state in which they overlap each other vertically along the right-hand side face of the exhaust chamber 16, and then are bent downward and are connected to the branch pipes 42*a* and 42*b* of the rear manifold pipe 42.

The outlet pipe 40 projects rightwards from a rear end of an inner surface of the exhaust chamber 16, and is connected, using a band 64, to a front pipe 63 which projects leftwards from a front end of an inner surface of the front portion 60. The front pipe 63 is an inlet pipe of the muffler 17, and has a passage sectional area Sa (see FIG. 6) on an inlet side which serves as a basis for the calculation of a sectional area ratio.

The connection between the outlet pipe 40 and the front pipe 63 is positioned somewhat backward and downward with respect to the front end 60*a* of the front portion 60, and a part of a band 65 which fixes the connection between the rear exhaust pipe 13 and the rear manifold pipe 42 faces the resulting space. An outer side face 60*c* of the front portion 60 is a tapered face whose front side is inclined toward the center of the vehicle body.

An outer side face 15*d* of a rear wall 15*c* of the catalyst chamber 15 is formed as a tapered face on its rear side so as to get inwards of the vehicle body and is throttled to a thickness of about the same diameter as the rear exhaust pipe 47, forming a recessed space outwardly sideways of the rear exhaust pipe 47. This recessed space is surrounded by the rear wall 15*c* and a front wall 16*a* of the exhaust chamber 16. The exhaust valve 53 is accommodated in the recessed space and is thereby protected against disturbance such as flying stones for example.

Figure 6:
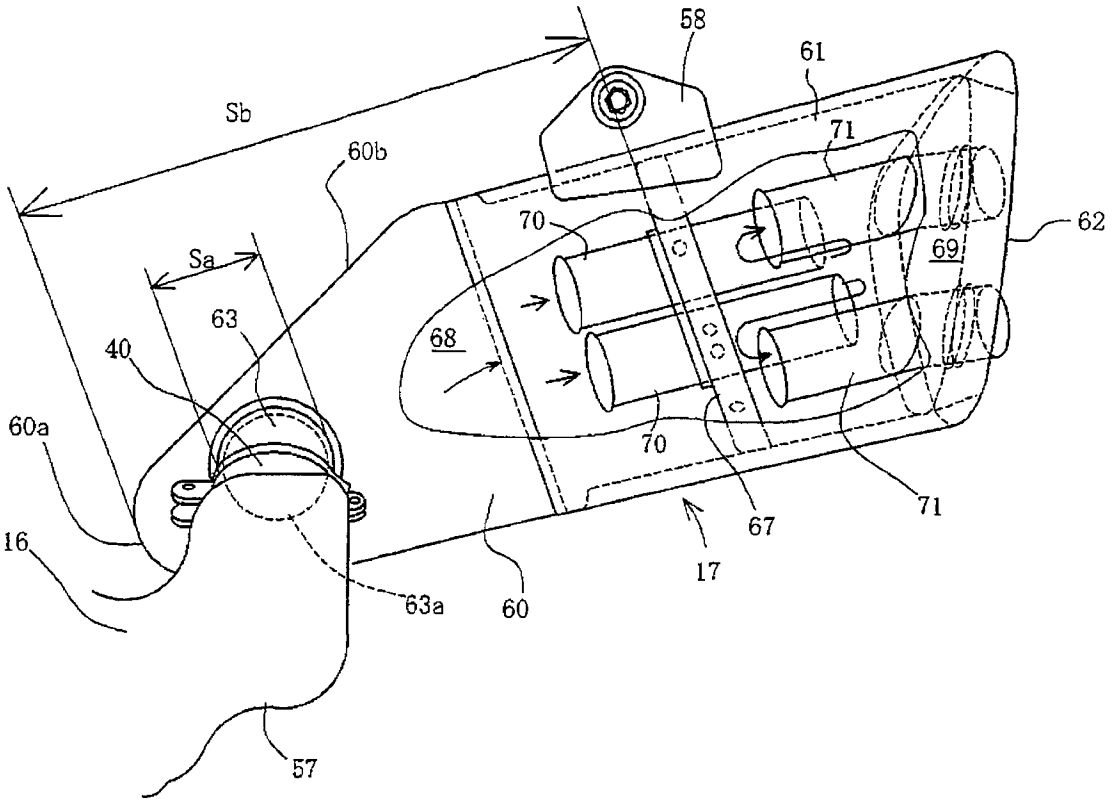
FIG. 6 is an enlarged side view mainly of a muffler according to an embodiment of the present invention.

FIG. 6 is an enlarged side view of the muffler 17, including the connection of the outlet pipe 40. The interior of the body portion 61 is partitioned into front and rear chambers by a separator 67. The portion located on the front side of the separator 67 is a front chamber 68 communicating with the interior of the front portion 60, while the portion located behind the separator 67 is a relatively small rear chamber 69 formed between the separator and the end cap 62.

Two upper and lower communication pipes 70 extend longitudinally through the separator 67 to provide communication between the front chamber 68 and the rear chamber 69. Likewise, two upper and lower tail pipes 71 extend longitudinally through the end cap 62. The tail pipes 71 are disposed so as to be offset sideways to the left from the axes of the communication pipes 70. Rear end-side portions of the communication pipes 70 lying in the interior of the rear chamber 69 overlap the front portions of the tail pipes 71 on the right-hand side.

A front end of the upper tail pipe 71 lies at a position retracted from the separator 67, while a front end portion of the lower tail pipe 71 lies at a position close to the separator 67. Rear end portions of the tail pipes 71 are bent to the right and open into the atmosphere just after leaving the end cap 62.

The muffler 17, with a large sectional area ratio, further exhibits an outstanding exhaust noise reducing effect. When the muffler 17 is seen along the axis of the front pipe 63 upon expansion of the exhaust gas in the front chamber 68 from the front pipe, a passage sectional area in the front chamber 68 in which the exhaust gas expands is of the range Sb from the front end 60*a* up to the separator 67. Therefore, if the passage sectional area of the front pipe 63 is Sa, it follows that the exhaust gas expands from Sa to Sb. Consequently, the sectional area ratio Sb/Sa becomes extremely large, about 7.0 in this embodiment. In comparison with the case where the front pipe 63 is connected from the front side of the front portion 60, the sideways connection in this embodiment gives a sectional area ratio which is about 75% larger. Therefore, the sound volume can be reduced significantly and effectively.

Next, the operation of this embodiment will be described. Exhaust gases in the front cylinders 10 pass the front side of the engine 3 from the front exhaust pipes 12, are gathered into the front manifold pipe 41 at a lower position, and then get into the catalyst chamber 15 from the front side of the vehicle body. The front exhaust pipes 12 and the font manifold pipe 41 correspond to the first exhaust pipe defined in the present invention. Since the first exhaust pipe is relatively short, the exhaust gas passing through the pipe enters the catalyst chamber 15 while retaining a relatively high temperature, and promotes early-stage activation of the catalyst disposed in the interior of the catalyst chamber.

Exhaust gases in the rear cylinders 11 are gathered from the rear exhaust pipes 13 into the rear manifold pipe 42 at a position behind the engine 3. The exhaust gases, by the rear manifold pipe 42, pass forward from behind the engine and along the right side face of the storage chamber 45 (corresponding to the expanded portion) of the oil pan, turn back around the front side of the engine, and then get into the catalyst chamber 15 from the front side of the vehicle body and in parallel with the front manifold pipe 41. The rear exhaust pipes 13 and the rear manifold pipe 42 correspond to the second exhaust pipe defined in the present invention.

The exhaust gases from the front and rear cylinders are gathered within the catalyst chamber 15 and the thus-combined exhaust gas is purified by a redox reaction promoted by the catalyst present within the catalyst chamber. At this time, both primary expansion and purification of the exhaust gas proceed simultaneously within the catalyst chamber 15. The purified exhaust gas is throttled by the rear exhaust pipe 47 and flows toward the exhaust chamber 16. The exhaust valve 53 disposed in the rear exhaust pipe 47 controls the throttle in a variable manner in accordance with the engine speed. When the engine speed is low, the exhaust valve 53 throttles the exhaust gas flow to reduce the exhaust noise, while when the engine speed is high, the exhaust valve 53 is opened to permit a high output.

The exhaust gas which has entered the exhaust chamber 16 from the rear exhaust pipe 47 undergoes secondary expansion within the exhaust chamber 16. The exhaust gas here expands largely because the capacity of the exhaust chamber 16 is larger than that of the catalyst chamber 15, thereby diminishing its energy. The exhaust gas after the expansion is again throttled in the rear portion of the exhaust chamber, flows out sideways to the right from the outlet pipe 40, and then flows through the front pipe 63 into the front chamber 68 of the muffler 17 from the left side.

Within the front chamber 68, the exhaust gas undergoes tertiary expansion. At this time, since the front pipe 63 is sideways connected to the front chamber 68, a large sectional area ratio Sb/Sa is obtained, whereby the sound volume can be reduced effectively. Thereafter, the exhaust gas is further throttled by the communication pipes 70, undergoes quaternary expansion within the rear chamber 69, and then is eventually released into the atmosphere from the tail pipes 71. At this time the exhaust gas is in a fully purified state and with exhaust noise sufficiently reduced as a result of expansion and throttling performed several times.

Since the catalyst chamber 15 is disposed below the crankcase 14 and sideways in parallel with the storage chamber 45 formed in the oil pan 43, and the front and rear manifold pipes 41, 42 are connected to the engine 3 from the front side of the engine, the bottom of the catalyst chamber 15 can be made substantially level with the bottom of the storage chamber 45. Therefore, not only can it ensure a sufficient minimum road clearance, but also it can attain the mass concentration and lowering of the center of gravity.

Further, the catalyst chamber 15 is disposed on one of both side faces of the oil pan 43. The rear manifold pipe 42 is disposed on the other side. Out of the first exhaust pipe (which comprises the front exhaust pipes 12 and the front manifold pipe 41) and the rear manifold pipe 42 (which constitutes the second exhaust pipe), the portions which extend curvedly to the front side of the engine 3 are disposed in front of the catalyst chamber 15. Thus, the front exhaust pipes 12, the front manifold pipe 41, the rear manifold pipe 42 and the catalyst chamber 15 are gathered around the oil pan 43, thereby ensuring a minimum road clearance and the lowering of the center of gravity and the mass concentration.

Moreover, if the components in question are arranged so as to surround the storage chamber 45 of the oil pan 43, they can be arranged in a more concentrated manner to the central portion of the engine. Besides, since the catalyst chamber 15 and the rear manifold pipe 42, as heating sources, are arranged with the storage chamber 45 therebetween, the space under the thin oil pan 43 is utilized. Therefore, a minimum road clearance can be further ensured and it is possible to lower the center of gravity and the mass concentration.

Particularly, the catalyst chamber 15 and the rear manifold pipe 42 can be approximated to the center of gravity of the engine 3 which is disposed near the center of gravity of the vehicle body. This is advantageous to the mass concentration.

Besides, since the catalyst is accommodated within the catalyst chamber 15 as a manifold portion, it becomes easier to dispose the catalyst, and the lowering of the center of gravity and the mass concentration become more remarkable to an extent corresponding to the weight increase of the catalyst.

Moreover, since the catalyst is disposed near the exhaust ports of the front cylinders 10 as an upstream side of exhaust gas, the exhaust gas of a relatively high temperature flows into the catalyst chamber 15 and comes into contact with the catalyst. Therefore, it is possible to effect early-stage activation of the catalyst. Besides, warming-up is further shortened by the heat generation of the catalyst. Moreover, since the catalyst is not only surrounded by the rigid case of the catalyst chamber 15 but also guarded by the front exhaust pipes 12, front manifold pipe 41, rear manifold pipe 42 and oil pan 43, the protection against disturbance is strengthened.

Further, in front of the catalyst chamber 15, the upwardly projecting $O_2$ sensors 51 are provided in the front manifold pipe 41 and the rear manifold pipe 42, respectively so that the front and lower sides of the $O_2$ sensors 51 can be surrounded with the front exhaust pipes 12 and the front and rear manifold pipes 41, 42, and the rear side thereof can be surrounded with the front portion of the crankcase 4 and the catalyst chamber 14. As a result, flying stones and the like become difficult to reach the $O_2$ sensors 51. Therefore, the protection of the $O_2$ sensors 51 against disturbance is ensured.

Additionally, since oil can be stored in the downwardly projecting, longitudinally elongated and narrow storage chamber 45 formed partially at the center of the bottom of the oil pan 43, a sufficient amount of oil is ensured in this portion. That is, the other portion of the bottom 44 functions as an inlet portion of oil flowing toward the storage portion 42 rather than functioning as an oil storage portion. Therefore, the other portion of the bottom 44 can be formed relatively thin without projecting downward too much. Consequently, the oil pan 43 as a whole can be formed thin in a generally T shape. Thus, not only can a sufficient oil storage capacity of the oil pan be ensured within the storage chamber 45, but also it is possible to form a thinner bottom portion 44 (except for the storage chamber 45), thereby ensuring a space thereunder for disposing the catalyst chamber 15 and the rear manifold pipe 42 with a sufficient minimum road clearance.

Further, since the suction port of the strainer 46 is disposed within the storage chamber 45 to suck oil, even if the oil pan 43 is thin as a whole, not only can the strainer 46 be accommodated within the oil pan 43, but also it is possible to effect the suction of oil efficiently. Moreover, since oil can be stored at a certain degree of depth within the relatively narrow storage chamber 45, it is possible to ensure an appropriate amount of oil at all times and hence possible to prevent the occurrence of oil shortage upon tilting of the vehicle body.

The invention being thus described, it will be obvious that the same may be varied in many ways. For example, as the manifold portion disposed below the engine, the catalyst chamber may be substituted by an exhaust chamber which is a mere expansion chamber. It is not only possible to ensure a sufficient minimum road clearance but also possible to attain the mass concentration and a lowering of the center of gravity. Such variations are not to be regarded as a departure from the spirit and scope of the invention, and all such modifications as would be obvious to one skilled in the art are intended to be included within the scope of the following claims.

What is claimed is:

1. An exhaust system for a motorcycle, comprising:

a plurality of exhaust pipes connected respectively to exhaust ports of cylinders of a multi-cylinder engine;

a catalyst chamber connected to two of the exhaust pipes; and a muffler connected to a downstream side of the catalyst chamber, the catalyst chamber being disposed below the engine, wherein the catalyst chamber is disposed sideways of an oil pan disposed below the engine so as to overlap the oil pan when seen in a side view of the motorcycle, and the two of the exhaust pipes are connected to the catalyst chamber from a front side of the motorcycle, wherein the catalyst chamber is disposed directly below only one of a left portion and a right portion of the oil pan, the two of the exhaust pipes are disposed directly below the one of the left portion and the right portion of the oil pan, one of the two of the exhaust pipes is disposed directly below the other one of the left portion and the right portion of the oil pan, and the oil pan has an oil storage chamber at a central portion of the oil pan that is between the left portion and the right portion of the oil pan.

2. The exhaust system according to claim 1, wherein a bottom of the oil pan has a downwardly expanded portion, and the catalyst chamber is disposed sideways of the expanded portion and in parallel with the expanded portion.

3. The exhaust system according to claim 2, wherein a suction port of a strainer for sucking oil is disposed within the expanded portion.

4. The exhaust system according to claim 1, wherein the multi-cylinder engine is a longitudinal V engine, the exhaust port of a front cylinder is connected to the other one of the two of the exhaust pipes, and the exhaust port of a rear cylinder is connected to the one of the two of the exhaust pipes, the other one of the two of the exhaust pipes extending in front of the engine and being connected to the catalyst chamber from the front side of the motorcycle, the one of the two of the exhaust pipes extending from behind the engine, passing a side face of the oil pan below the engine, and extending curvedly in front of the engine and being connected to the catalyst chamber from the front side of the motorcycle, and the side face of the oil pan lies on a side opposite to a disposed side of the catalyst chamber.

5. The exhaust system according to claim 4, wherein the one of the two of the exhaust pipes passes an opposite side of the catalyst chamber with the expanded portion of the oil pan therebetween.

6. The exhaust system according to claim 4, wherein a catalyst is disposed in the catalyst chamber.

7. The exhaust system according to claim 4, wherein an $O_2$ sensor is disposed on the exhaust pipe positioned in front of the catalyst chamber.

8. The exhaust system according to claim 1, wherein the oil storage chamber projects downwardly at the central portion of the oil pan, and the catalyst chamber overlap the storage chamber of the oil pan when seen in a lateral side view of the vehicle.

9. The exhaust system according to claim 8, wherein a bottom of the catalyst chamber is substantially level with a bottom of the storage chamber.

10. An exhaust system for a vehicle, comprising:

a plurality of exhaust pipes connected respectively to exhaust ports of a multi-cylinder engine; and a catalyst chamber connected to two of the exhaust pipes, the catalyst chamber being disposed below the engine;

wherein the catalyst chamber is disposed sideways of an oil pan disposed below the engine so as to overlap the oil pan when seen in a lateral side view of the vehicle, and wherein the catalyst chamber is disposed directly below only one of a left portion and a right portion of the oil pan, the two of the exhaust pipes are disposed directly below the one of the left portion and the right portion of the oil pan, one of the two of the exhaust pipes is disposed directly below the other one of the left portion and the right portion of the oil pan, and the oil pan has an oil storage chamber at a central portion of the oil pan that is between the left portion and the right portion of the oil pan.

11. The exhaust system according to claim 10, wherein a catalyst is disposed in the catalyst chamber.

12. The exhaust system according to claim 10, wherein an $O_2$ sensor is disposed on one of the two of the exhaust pipes positioned in front of the catalyst chamber, and the two of the exhaust pipes are connected to the catalyst chamber from a front side of the vehicle.

13. The exhaust system according to claim 10, wherein the oil storage chamber projects downwardly at the central portion of the oil pan, and the catalyst chamber overlap the storage chamber of the oil pan when seen in a lateral side view of the vehicle.

14. The exhaust system according to claim 13, wherein a bottom of the catalyst chamber is substantially level with a bottom of the storage chamber.

* * * * *